US011466486B2

(12) United States Patent
Inan et al.

(10) Patent No.: US 11,466,486 B2
(45) Date of Patent: Oct. 11, 2022

(54) MOTOR VEHICLE DRIVE ASSEMBLY

(71) Applicant: Kiekert AG, Heiligenhaus (DE)

(72) Inventors: Ömer Inan, Dorsten (DE); Michael Scholz, Essen (DE); Holger Schiffer, Meerbusch (DE); Peter Szegeny, Engelskirchen (DE)

(73) Assignee: Kiekert AG, Heiligenhaus (DE)

( * ) Notice: Subject to any disclaimer, the term of this patent is extended or adjusted under 35 U.S.C. 154(b) by 106 days.

(21) Appl. No.: 17/044,086

(22) PCT Filed: Apr. 5, 2019

(86) PCT No.: PCT/DE2019/100313
§ 371 (c)(1),
(2) Date: Sep. 30, 2020

(87) PCT Pub. No.: WO2019/201380
PCT Pub. Date: Oct. 24, 2019

(65) Prior Publication Data

US 2021/0032912 A1 Feb. 4, 2021

(30) Foreign Application Priority Data

Apr. 20, 2018 (DE) ..... 10 2018 109 477.9

(51) Int. Cl.
*E05B 81/50* (2014.01)
*E05B 81/06* (2014.01)
(Continued)

(52) U.S. Cl.
CPC ..... *E05B 81/50* (2013.01); *E05B 81/06* (2013.01); *E05B 81/14* (2013.01); *E05B 81/34* (2013.01);
(Continued)

(58) Field of Classification Search
CPC ..... Y10T 292/1082; E05B 2015/042; E05B 81/06; E05B 81/50; E05B 81/34
See application file for complete search history.

(56) References Cited

U.S. PATENT DOCUMENTS 5,020,838 A * 6/1991 Fukumoto ..... E05B 81/14 292/216
5,934,717 A * 8/1999 Wirths ..... E05B 81/14 292/216
(Continued)

FOREIGN PATENT DOCUMENTS

DE 10240552 A1 * 3/2004 ..... E05B 81/25
DE 10226355 B3 4/2004
(Continued)

OTHER PUBLICATIONS

Translation of International Search Report dated Jul. 31, 2019 for PCT/DE2019/100313.

*Primary Examiner* — Carlos Lugo
(74) *Attorney, Agent, or Firm* — Renner, Otto, Boisselle & Sklar, LLP

(57) ABSTRACT

A motor vehicle drive assembly, which is equipped with an electric motor and an output element, which is driven by the electric motor indirectly or directly. Furthermore, a spring associated with the output element is realized, which spring is designed to bidirectionally return the output element. According to the invention, the spring is designed as a spiral spring which is designed to be windable and unwindable proceeding both from the inner spring let and from the outer leg.

17 Claims, 2 Drawing Sheets

(51) Int. Cl.
*E05B 81/14* (2014.01)
*E05B 81/34* (2014.01)
*E05B 15/04* (2006.01)

(52) U.S. Cl.
CPC ... *E05B 2015/042* (2013.01); *E05Y 2201/434* (2013.01); *E05Y 2201/482* (2013.01); *E05Y 2201/702* (2013.01); *E05Y 2201/704* (2013.01); *E05Y 2900/531* (2013.01); *Y10T 292/1082* (2015.04)

(56) References Cited

U.S. PATENT DOCUMENTS 5,938,253 A * 8/1999 Szablewski ..... E05B 81/14 292/201
6,155,124 A * 12/2000 Wirths ..... E05B 81/25 292/201
6,386,599 B1 * 5/2002 Chevalier ..... E05B 77/28 292/201
6,390,517 B1 * 5/2002 Ehret ..... E05B 81/14 292/216
6,923,480 B2 8/2005 Shafry
7,128,191 B2 10/2006 Fisher
7,163,239 B2 * 1/2007 Fisher ..... E05B 81/14 292/201
2005/0212302 A1 * 9/2005 Fisher ..... E05B 81/14 292/216

FOREIGN PATENT DOCUMENTS

DE 102006053178 A1 * 5/2008 ..... E05B 77/28
DE 112012002272 T5 3/2014
EP 1225290 A2 7/2002
GB 470358 A * 8/1937
WO WO-2016150432 A1 * 9/2016 ..... E05B 77/10

* cited by examiner

MOTOR VEHICLE DRIVE ASSEMBLY

FIELD OF INVENTION

The invention relates to a motor vehicle drive assembly, which is equipped with an electric motor and at least one output element, which is indirectly or directly driven by the electric motor, and a spring associated with the output element, which spring is designed to bidirectionally return the output element.

BACKGROUND OF INVENTION

Motor vehicle drive assemblies are widely used in motor vehicles. Examples of this are mirror adjustments, seat adjustments, window regulators, but also unlocking devices on engine hoods, tailgates, and the like. Furthermore, such motor vehicle drive assemblies are increasingly used in connection with the locking and unlocking of charging plugs in associated receptacles in electric vehicles. In the scope of the present application, motor vehicle drive assemblies are very particularly preferred which are used in connection with motor vehicle doors and here in particular in connection with motor vehicle door latches.

Such motor vehicle drive assemblies can be used, for example, in connection with a closing drive, a door drive, and the like. In connection with motor vehicle door latches, such motor vehicle drive assemblies are used, for example, in connection with a so-called "electrical opening" process or also for implementing a central locking function. In all of these cases, it is often important that the output element driven or acted upon with the aid of the electric motor is returned to an idle position after it has been acted upon by the electric motor. This is typically provided by the spring associated with the output element, which provides for the return of the output element.

Since the spring is bidirectionally returned in the scope of the present application and is thus set up for bidirectional return of the output element, the output element can be returned, depending on, for example, its direction of rotation, by being acted upon both clockwise and counterclockwise with the aid of the single, bidirectionally acting spring, in each case into its zero position or neutral position.

The generic prior art according to DE 11 2012 002 272 T5 uses a return lever in this context, which return lever is returned in both directions with the aid of an associated leg spring. Such leg springs are often realized and used in practice for the purposes described. In a long-term operation, such leg springs often have a high impact, which can shorten their service life.

A comparable generic motor vehicle drive assembly is described in DE 102 26 355 B3. It relates to an operating device, in particular for a vehicle door latch. The operating device has an adjusting lever which can be pivoted about an axis of rotation between two stop or end positions by interacting with a cam wheel. The cam wheel is in turn driven by an electric motor. Furthermore, means for spring action upon the adjusting lever are provided in each end position thereof. This can be a bistable spring, which is referred to in the publication as a "flip-flop spring."

The motor vehicle door latch made known from EP 1 225 290 A2 also belongs to the further prior art. This has a motor vehicle drive assembly, in the specific case a pawl drive. The pawl drive acts by means of an output pulley on an extension on the pawl to release a catch. For this purpose, the output pulley has a guide curve for the extension which moves along said guide curve. Furthermore, the output pulley is equipped with a spiral return spring for the entire pawl drive. The return spring abuts against a stop with its end remote from the center and can only have an effect in one direction.

SUMMARY OF INVENTION

The invention is based on the technical problem of further developing such a motor vehicle drive assembly in such a way that permanently safe operation is ensured. Furthermore, it should be possible to realize higher spring torques than before.

To solve this technical problem, a generic motor vehicle drive assembly within the scope of the invention is characterized in that the spring set up for bidirectionally returning the output element is designed as a spiral spring which is designed to be windable from both the inner and the outer spring legs.

In the scope of the invention, a spiral spring is used for the first time as a bidirectional spring. The spiral spring acting in two directions is windable on the one hand proceeding from the outer spring leg and on the other hand proceeding from the inner spring leg, so that in this way the output element is acted upon with the desired return forces in both principal directions with the aid of the spiral spring.

The output element is advantageously a worm wheel which rotates back and forth about an axis. As a result, the worm wheel can execute clockwise as well as counterclockwise rotational movements. In both directions, the worm wheel ensures that the spiral spring is tensioned. After the worm wheel is no longer acted upon, the spiral spring ensures, according to the invention, that the worm wheel is returned to a neutral position or idle position with the aid of the spiral spring.

In order to implement this in detail, the inner spring leg of the spiral spring is equipped with a connected lever. For this purpose, the lever is provided in detail with an opening which is designed for engagement of the inner spring leg. The output element for its part has a contour that interacts with the spiral spring. The connected lever can also be designed in two parts and/or the lever and spiral spring can be arranged on a common axis that is present as a separate component. Also As a rule, the contour as well as the spiral spring are arranged on a rear side of the output element. In contrast, there is usually at least one operating contour on the front side of the output element. With the help of the operating contour of the output element, when using the motor vehicle drive assembly, for example for electrical opening, a release lever of a motor vehicle door latch can be acted upon, which in turn lifts an associated pawl as part of a locking mechanism consisting of pawl and catch from its engagement with the catch. In principle, the operating contour in the field of application described can also work on a central locking lever in conjunction with motor vehicle door latches and pivot this, for example, into the two positions "unlocked" and "locked."

In addition, other fields of application are also conceivable in such a way that the operating contour interacts with a child safety lever, for example by acting on such a child safety lever. In this way, with the aid of the operating contour, the child safety lever can be transferred into its "child-safe" and "child-unlocked" positions. In principle, the operating contour can also interact with an anti-theft lever and transfer it in a comparable manner into the positions "theft-protected" and "theft-unlocked." Of course, all of this is only an example and is by no means restrictive.

Either way, the worm wheel generally executes rotational movements around its axis of rotation, both clockwise and counterclockwise. Rotational movements of the at least one operating contour on the front side of the output element that correspond to the corresponding rotary movements. As a result, the operating contour is able to implement the previously described and exemplary positions such as, for example, lifting the pawl or transferring a central locking lever into the "unlocked" and "locked" positions. For the output element to be returned into the idle position or the neutral position after it has been acted upon with the help of the electric motor, in order to be able to implement a further electrical opening process or central locking process, the corresponding movement of the output element in both directions (clockwise and counterclockwise) ensures that the spiral spring is tensioned. For this purpose, the contour interacts with both the outer spring leg of the spiral spring and the lever and thus the inner spring leg of the spiral spring. In other words, the output element advantageously only has a single contour which acts on both the lever and the outer spring leg of the spiral spring, depending on the direction of rotation and action of the output element. In principle, it is of course also possible to work with two or more different contours. In principle, the embodiment of the invention can also be made such that the connected lever has the operating contour.

Either way, a particularly permanent and functionally reliable operation of the motor vehicle drive assembly according to the invention is first made available. This is because the use of the spiral spring, which acts as it were bidirectional for returning, means that the spiral spring in question can be used to realize higher spring torques and thus return torques for the output element compared to a leg spring. In other words, such spiral springs can basically be equipped with larger spring constants than leg springs in the context described. In addition, spiral springs generally allow a much larger control range of the output element and the associated contour than is observed with leg springs. As a result of this, a significantly higher strength and thus also an increased service life is observed for spiral springs compared to leg springs or also helical coil springs. This is especially true in the event that relatively high return torques are required on the output element. In addition, there is space to accommodate the spiral spring together with the contour and the lever connected to the inner spring leg of the spiral spring on the back of the output element and, in this way, only a small amount of installation space is required. In other words, a particularly compact embodiment is provided.

In contrast to, for example, a leg spring, as described in the context of the generic prior art according to DE 11 2012 002 272 T5, the spiral spring used according to the invention is acted upon in its longitudinal direction when operating the output element. In contrast, the leg spring is acted upon transversely to the longitudinal extension during such a process. As a result of this, material fatigue and fractures can occur in such leg springs in the event of high loads and long-term operation. In contrast, spiral springs are characterized by their application of force and spring action in the longitudinal direction, not only by possible high spring constants, but also, as a consequence, by the fact that permanent and safe operation provided. This is where the main advantages can be seen.

BRIEF DESCRIPTION OF DRAWINGS

The invention is explained in more detail below on the basis of an exemplary embodiment shown in the drawings; in which.

DETAILED DESCRIPTION

A motor vehicle drive assembly is shown in the figures. In the present case, the motor vehicle drive assembly is installed in a housing 1 of a motor vehicle door latch. This is of course only an example and is in no way restrictive.

Figure 1:
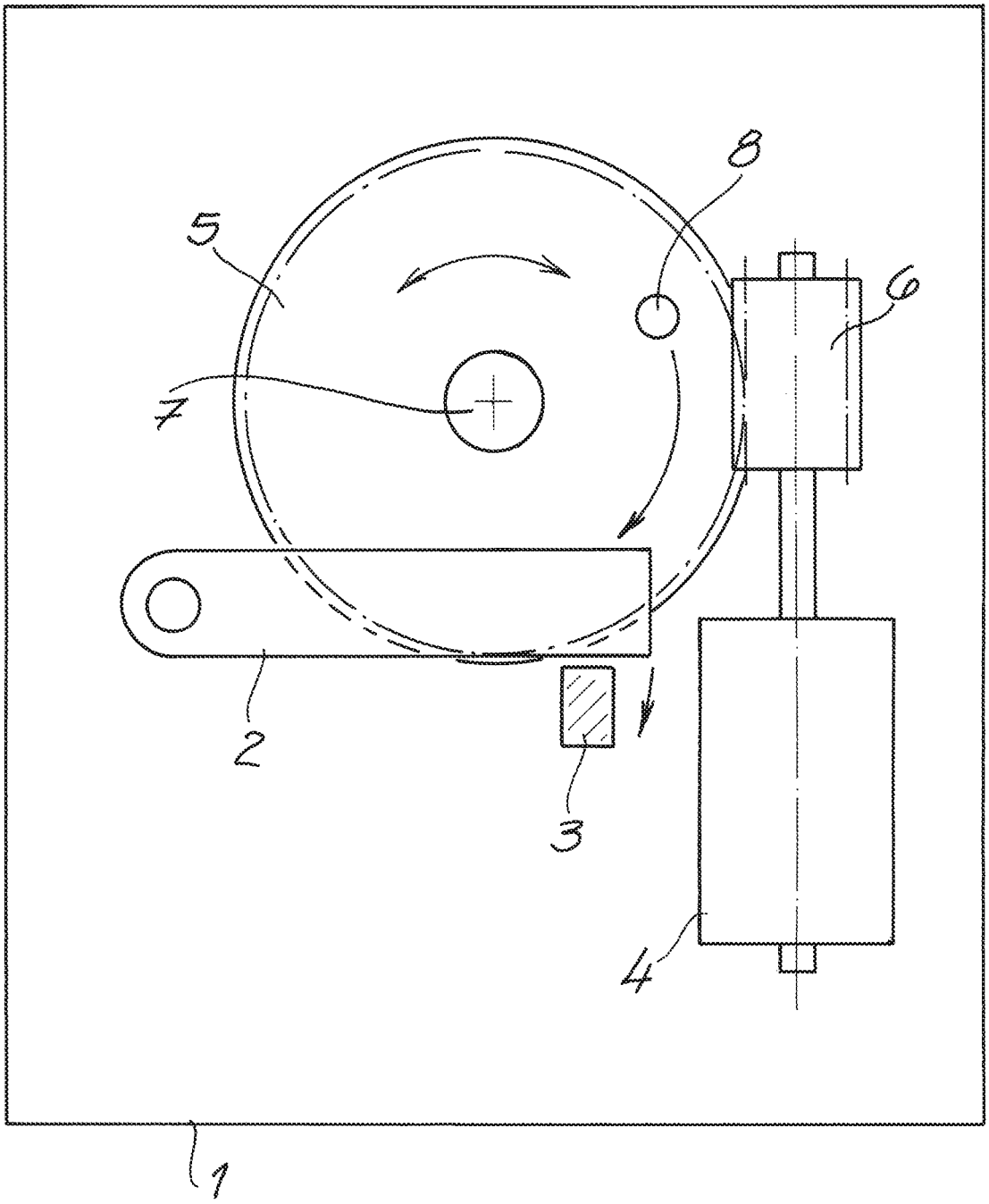
FIG. 1 shows the motor vehicle drive assembly according to the invention in an application in the interior of a motor vehicle door latch in a front view and FIG. 2 shows the subject matter of FIG. 1 in the associated rear view.

The motor vehicle door latch having the housing 1 indicated in FIG. 1 has conventional components in its interior such as a release lever 2 and a pawl 3 as part of a locking mechanism (not shown in detail). The motor vehicle drive assembly has an electric motor 4 as well as an output element 5 driven indirectly or directly with the aid of the electric motor 4.

In the exemplary embodiment, the electric motor 4 provides a direct drive for the output element 5. For this purpose, the electric motor 4 has on the output side an output worm 6 on its output shaft, which meshes with a toothing (not shown in detail), on the output element 5 designed as a worm wheel 5. In this way, the worm wheel 5 can perform clockwise and counterclockwise rotational movements about its axis 7 indicated in FIG. 1, as indicated by a double arrow in FIG. 1. In an alternative embodiment (not shown), the electric motor 4 drives the output element 5 only indirectly, for example via a transmission connected in between.

A clockwise rotation of the worm wheel 5 ensures that an operating contour 8 arranged on the front side of the worm wheel 5 comes to abutment on the release lever 2 after completing an operating path indicated in FIG. 1. The further clockwise movement of the operating contour 8 then ensures that the release lever 2 is also pivoted clockwise about its axis indicated in FIG. 1, as shown by a further arrow in FIG. 1. The pivoting movement of the operating lever 2 has the effect that the pawl 3 is lifted from its engagement with a catch (not shown in detail). The associated locking mechanism arranged perpendicular to the plane of the drawing in FIG. 1 is opened. In other words, the illustrated motor vehicle drive assembly is implemented and used in the example of FIG. 1 for the "electrical opening" process of the motor vehicle door latch or its locking mechanism illustrated therein.

Figure 2:
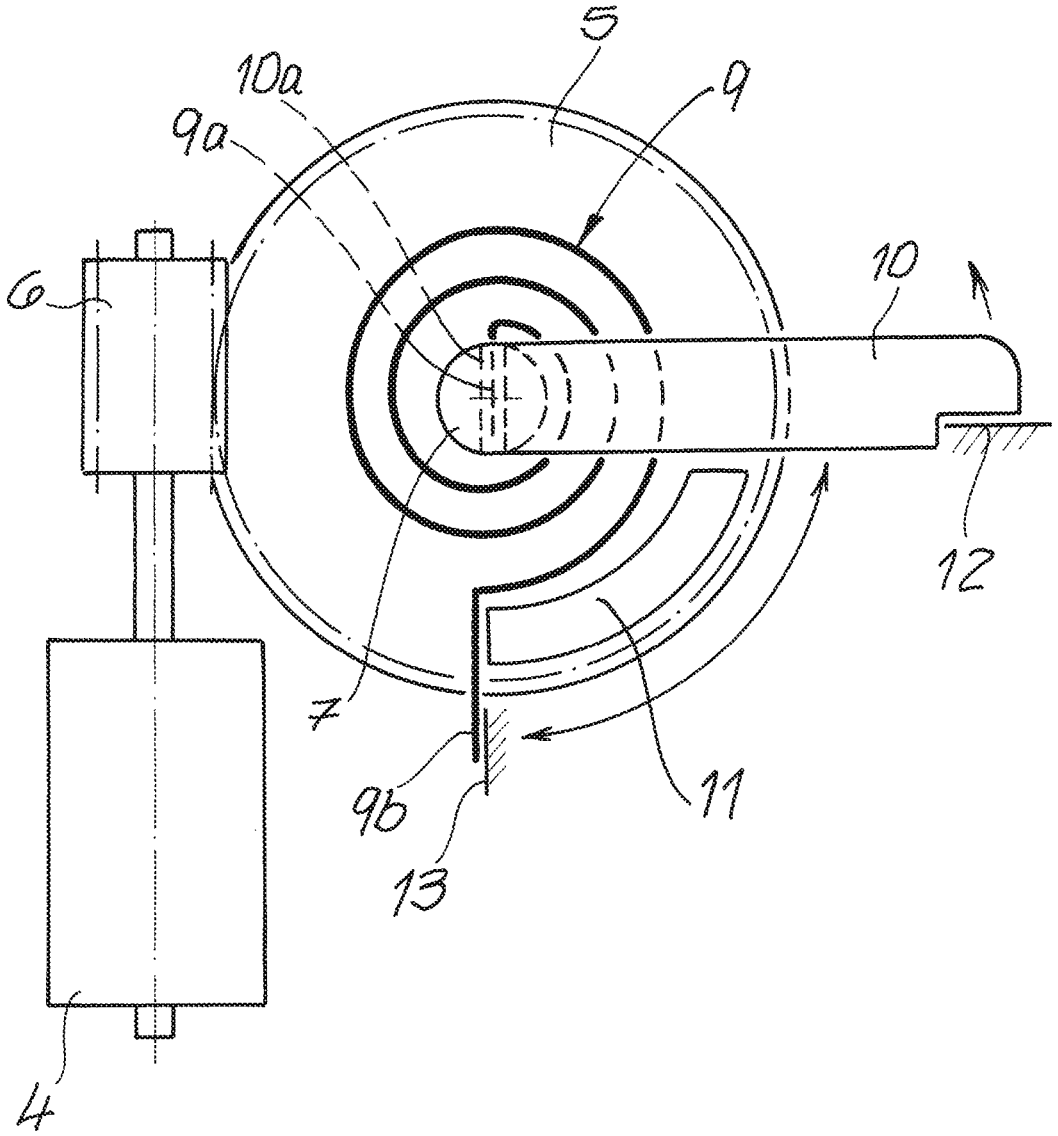

Based on FIG. 2 with the associated rear view of the motor vehicle drive assembly already described above, it is clear that a spring 9 assigned to the output element 5 is also provided. The spring 9 is set up for the bidirectional return of the output element 5. In other words, the spring 9 ensures in both directions of rotation of the worm wheel 5, in principle indicated in FIG. 1, that—after the electric motor 4 no longer acts on the worm wheel 5—the worm wheel 5 is transferred to its neutral position or idle position shown in solid lines in FIG. 1. For this purpose, the spring 9 is tensioned in both directions of rotation during a corresponding movement process. As soon as the electric motor 4 no longer acts on the worm wheel 5, the spring 9 can relax and ensures that the worm wheel 5 is returned to the neutral position or idle position shown in FIG. 1 when acted upon by a spring.

According to the invention, the spring 9 is a spiral spring 9. The spiral spring 9 has an inner spring leg 9*a* and an outer spring leg 9*b*. In this way, the spiral spring 9 is windable both proceeding from the inner spring leg 9*a* and proceeding from the outer spring leg 9*b*, as will be explained in more detail below. In fact, the inner spring leg 9*a* of the spiral spring 9 has a connected lever 10. The lever 10 is equipped with an opening 10*a*, into which the inner spring leg 9*a* of the spiral spring 9 engages.

The lever 10 is rotatably connected to the output element 5. Usually, the common axis 7 is used. Since the lever 10 engages over the spiral spring 9, the spiral spring 9 is held in the interstice between the output element 5 and the lever 10. In addition, the end of the inner spring leg 9*a* is secured in the opening 10*a* of the lever 10.

The worm wheel 5 has a contour 11 which interacts with the spiral spring 9. The contour 11, like the spiral spring 9 and the lever 10, is located on the rear side of the worm wheel 5, whereas the operating contour 8 described above with reference to FIG. 1 is arranged on the front side of the worm wheel 5.

The overall design is such that the contour 11 can interact both with the outer spring leg 9*b* of the spiral spring 9 and with the lever 10 and thus the inner spring leg 9*a* of the spiral spring 9. In the scope of the exemplary embodiment, the contour 11 is designed as an arcuate contour, the radius of which is adapted to the radius of the circular worm wheel 5.

In this way, a counterclockwise and clockwise rotation of the worm wheel 5 indicated in FIG. 2 results in the contour 11 in question interacting with either the lever 10 and thus the inner spring leg 9*a* or the outer spring leg 9*b* of the spiral spring 9.

If, for example, the worm wheel 5 according to the rear view of FIG. 2 is driven with the aid of the electric motor 4 so that it executes a counterclockwise movement, then the contour 11 ensures that the lever 10 is also pivoted counterclockwise. As a result of this, the spiral spring 9 is tensioned by being wound, proceeding from the inner spring leg 9*a*, and the lever 10 moves away from an associated stop 12. In contrast, the outer spring leg 9*b* remains in the idle state due to its abutment with a further associated stop 13.

If, however, the worm wheel 5 is acted upon in a clockwise direction in the representation according to FIG. 2, the contour 11 works on the outer spring leg 9*b* and lifts it off the associated further stop 13. Subsequently, the inner spring leg 9*a* remains in the idle state via the lever 10 due to its abutment with the stop 12. In both cases, the spiral spring 9 is wound up both proceeding from the inner spring leg 9*a* and from the outer spring leg 9*b* and is tensioned as a result. As soon as the worm wheel 5 is no longer acted upon in the example shown, the spiral spring 9 can relax and the inner spring leg 9*a* or the connected lever 10 moves against the associated stop 12. The same applies to the outer spring leg 9*b*, which abuts against the associated stop 13 when the spiral spring 9 is relaxed.

The worm wheel 5 on the one hand and the spiral spring 9 on the other hand are designed independently of one another. In other words, the spiral spring 9 is held in abutment with the output element or worm wheel 5 with the aid of the lever 10, for example, but is not coupled to the worm wheel 5 in any way. As a result, the spiral spring 9 can be wound up and unwound as described both proceeding from the inner spring leg 9*a* and from the outer spring leg 9*b* with the aid of the worm wheel 5 or the contour 11 attached to it.

The invention claimed is:

1. A motor vehicle drive assembly comprising:

an electric motor;

an output element which is driven about a pivot axis by the electric motor indirectly or directly; and a spring associated with the output element, the spring being configured for a bidirectional return of the output element, wherein the spring is a spiral spring that is windable from both an inner spring leg and an outer spring leg;

a connected lever mounted on the pivot axis and engaged to the inner spring leg of the spring, wherein when the motor drives the output element in a first direction from a neutral position, the output element acts on the outer spring leg; and wherein when the motor drives the output element in a second direction from the neutral position, opposite the first direction, the output element acts on the connected lever, acting on the inner spring leg; and wherein when the motor stops acting on the outer element, tensioning created when the output element is in either first or second position, will move the output element back to the neutral position.

2. The motor vehicle drive assembly according to claim 1, wherein the connected lever has an opening for engagement of the inner spring leg.

3. The motor vehicle drive assembly according to claim 2, wherein the connected lever is rotatably connected to the output element.

4. The motor vehicle drive assembly according to claim 1, wherein the output element has a contour interacting with the spiral spring.

5. The motor vehicle drive assembly according to claim 4, wherein the contour and the spiral spring are arranged on a rear side of the output element.

6. The motor vehicle drive assembly according to claim 5, wherein the output element has an operating contour arranged on a front side of the output element that opposes the rear side, wherein the operating contour is configured to engage a component of a motor vehicle locking mechanism.

7. The motor vehicle drive assembly according to claim 4, wherein the contour can interact both with the outer spring leg of the spiral spring and with the connected lever engaged to the inner spring leg of the spiral spring.

8. The motor vehicle drive assembly according to claim 7, wherein the contour engages the connected lever of the inner spring leg when the motor drives the output element in the second direction and the contour engages the outer spring leg when the motor drives the output element in the first direction.

9. The motor vehicle drive assembly according to claim 8, wherein when the motor drives the output element in the second direction, the contour pivots the connected lever whereby the spring is tensioned from the inner spring leg and the outer spring leg is in an idle state, and wherein when the motor drives the output element in the first direction, the contour engages the outer spring leg whereby the outer spring leg is tensioned and the inner spring leg is in an idle state.

10. The motor vehicle drive assembly according to claim 9 further comprising a first stop against which the outer spring leg engages when in the idle state and a second stop against which the inner spring leg engages when in the idle state.

11. The motor vehicle drive assembly according to claim 4, wherein the contour has an arcuate shape and formed proximate an outer circumference of the output element.

12. The motor vehicle drive assembly according to claim 1, wherein the output element is a worm wheel.

13. The motor vehicle drive assembly according to claim 1, wherein the output element has an operating contour on a front side of the output element.

14. The motor vehicle drive assembly according to claim 13, wherein the operating contour interacts with a further component of the motor vehicle door latch, wherein the further component includes a central locking lever, a release lever, a child safety lever, or an anti-theft lever.

15. A motor vehicle door latch having a locking mechanism and having a motor vehicle drive assembly according to claim 1.

16. The motor vehicle door latch according to claim 15, wherein the output element is configured to engage a component of the locking mechanism.

17. A motor vehicle drive assembly comprising:

an electric motor;

an output element which is driven by the electric motor indirectly or directly; and a spring associated with the output element, the spring being configured for a bidirectional return of the output element, wherein the spring is a spiral spring that is windable from both an inner spring leg and an outer spring leg, wherein the output element has a contour interacting with the spiral spring, wherein the contour can interact both with the outer spring leg of the spiral spring and with a connected lever of the inner spring leg of the spiral spring, and wherein the contour is rotatable between a first position in which the contour engages the connected lever engaged to the inner spring leg to tension the spring in a first direction away from a neutral position of the spring and a second position in which the contour engages the outer spring leg to tension the spring in a second direction away from the neutral position of the spring.

* * * * *